US006611113B2

(12) United States Patent
Yang et al.

(10) Patent No.: US 6,611,113 B2
(45) Date of Patent: Aug. 26, 2003

(54) COOL CATHODE TUBE CONTROL CIRCUIT

(76) Inventors: Jui Piao Yang, 5F, No. 1, Yili St., Beitou Dist., Taipei (TW); Hsi Chen Chang, No. 128, Dade St., Shincheng Shiang, Hualien (TW)

( * ) Notice: Subject to any disclaimer, the term of this patent is extended or adjusted under 35 U.S.C. 154(b) by 50 days.

(21) Appl. No.: 10/033,966

(22) Filed: Jan. 3, 2002

(65) Prior Publication Data

US 2003/0122508 A1 Jul. 3, 2003

(51) Int. Cl.[7] ..... G05F 1/00

(52) U.S. Cl. ..... 315/308; 315/307; 315/292; 315/324; 315/291

(58) Field of Search ..... 315/307, 291, 315/292, 224, DIG. 4, 185 R, 194, 195, 196, 312, 316, 324

(56) References Cited

U.S. PATENT DOCUMENTS 5,930,121 A * 7/1999 Henry ..... 363/16
6,002,215 A * 12/1999 Yamashita et al. ..... 315/308
6,140,777 A * 10/2000 Wang et al. ..... 315/247
6,329,766 B1 * 12/2001 Liu et al. ..... 315/295

* cited by examiner

*Primary Examiner*—Don Wong
*Assistant Examiner*—Tuyet T. Vo
(74) *Attorney, Agent, or Firm*—Rosenberg, Klein & Lee

(57) ABSTRACT

A cool cathode tube control circuit for being connected to a lighting device and a plurality of lamp tubes. The cool cathode tube control device includes a regulator control circuit for controlling a lighting device to provide a steady high voltage power source. A lighting control circuit serves for controlling the lighting device so as to drive a plurality of lamp tubes and adjusting the illuminations of the lamp tubes. An abnormality detecting circuit is connected to the lighting device for sensing abnormal signals. A control logic circuit is electrically connected to the regulator control circuit, lighting control circuit and abnormality detecting circuit for receiving and processing input signals from the abnormality detecting circuit so as to generate logic digital signals to be transferred to the regulator control circuit and the lighting control circuit. Thereby, the lighting device is driven so that the plurality of lamp tubes are actuated synchronously and have the same illumination.

12 Claims, 10 Drawing Sheets

COOL CATHODE TUBE CONTROL CIRCUIT

BACKGROUND OF THE INVENTION

1. Field of the Invention

The present invention relates to a cool cathode tube control circuit, wherein a control logic circuit is electrically connected to a regulator control circuit, a lighting circuit, a fine-adjusting control circuit, and an abnormality detecting circuit for receiving the signals of a fine-adjusting setting circuit and the abnormality protecting circuit and process the received signals to output digital signals for driving the pre-stage voltage boost regulator and the lighting circuit of a lighting device. Thereby, the lighting device is driven so that the plurality of lamp tubes are actuated synchronously and have the same illumination.

2. Description of Related Art

The general cool cathode tube lighting device (referring to FIG. 1, only one lighting device is illustrated). The lighting device mainly includes a pre-stage voltage boost regulator 12 for providing a high voltage DC power source and a plurality of lighting circuits 14. Each lighting circuit 14 includes a resonant inductor 142, a resonant capacitor 144 and a transformer circuit 146 for driving the corresponding cool cathode tube 148. To avoid the damage of the system since the over-voltage or over-current occurs due to open circuit or short circuit of abnormal loads. The lighting device can be installed a plurality of abnormal protecting circuits 16 corresponding to each cool cathode tube 148. Thereby, the system is protected from an abnormal load. Besides, to be suitable in various conditions and environments, a fine-adjusting setting circuit 18 may be installed for fine-adjusting the condition of lighting.

However, when the lamp tubes are driven by a general lighting device of a cool cathode tube, the following events will occurs:

1. Variations of temperature induce responses of natural resonant frequencies.
2. Variations of temperature induce responses of the control current of the cool cathode tubes.
3. The variations of the control current of the cool cathode tubes induce responses of natural resonant frequencies.
4. As adjusting the illuminations of a plurality of lamp tubes, the illuminations of the lamp tubes can not be identical and the lighting frequencies thereof can not be identical.
5. The lighting frequency is not identical to that of the pre-stage voltage boost regulator. Thereby, the harmonic interference due to frequency difference and electromagnetic interference may occur easily.

Therefore, there is an eager demand for a novel cool cathode tube control circuit, which may improve above said prior defects so that the abnormality of load does not effect the lighting device and the illuminations of the plurality of lamp tubes may be identical.

SUMMARY OF THE INVENTION

Accordingly, the primary object of the present invention is to provide a cool cathode tube control circuit, wherein the cool cathode tube control circuit includes a regulator control circuit, a lighting control circuit, a fine-adjusting control circuit, and an abnormality detecting circuit for receiving the signals of a fine-adjusting setting circuit and the abnormality protecting circuit and processing the received signals to output digital signals for driving the pre-stage voltage boost regulator and the output the lighting circuit of a lighting device.

Another object of the present invention is to provide a cool cathode tube control circuit, wherein the regulator control circuit can control the pre-stage voltage boost regulator so as to provide a steady high voltage D.C. source.

Another object of the present invention is to provide a cool cathode tube control circuit, wherein in the lighting circuit, the lighting circuit generates various signals through a plurality of voltage shift converters for determining the cutting off and conduction of a power transistor so as to compensate the temperature to the response of the natural resonant variation and to the response of the current variation of the lamp tube. Furthermore, a plurality of lamp tubes can be driven synchronously and the illumination thereof can be adjusted so that they have the same illumination.

Another object of the present invention is to provide a cool cathode tube control circuit, wherein the pre-stage voltage boost regulator is synchronized with the light frequency of the lighting control circuit so as to reduce the interference of the harmonic of the difference frequency and the electromagnetic wave interference.

Another object of the present invention is to provide a cool cathode tube control circuit, wherein the abnormality detecting circuit may track and correct the lighting device immediately by detecting the abnormality of the lighting device through voltage feedback.

Another object of the present invention is to provide a cool cathode tube control circuit, wherein the fine-adjusting control circuit converts the analog illumination adjusting instruction, temperature setting instruction, on/off instruction of the analog protecting circuit and the base voltage adjusting instruction of the voltage regulator into digital signals for being used in the operation of the control logic circuit.

The various objects and advantages of the present invention will be more readily understood from the following detailed description when read in conjunction with the appended drawing.

DETAILED DESCRIPTION OF THE PREFERRED EMBODIMENTS

Figure 1:
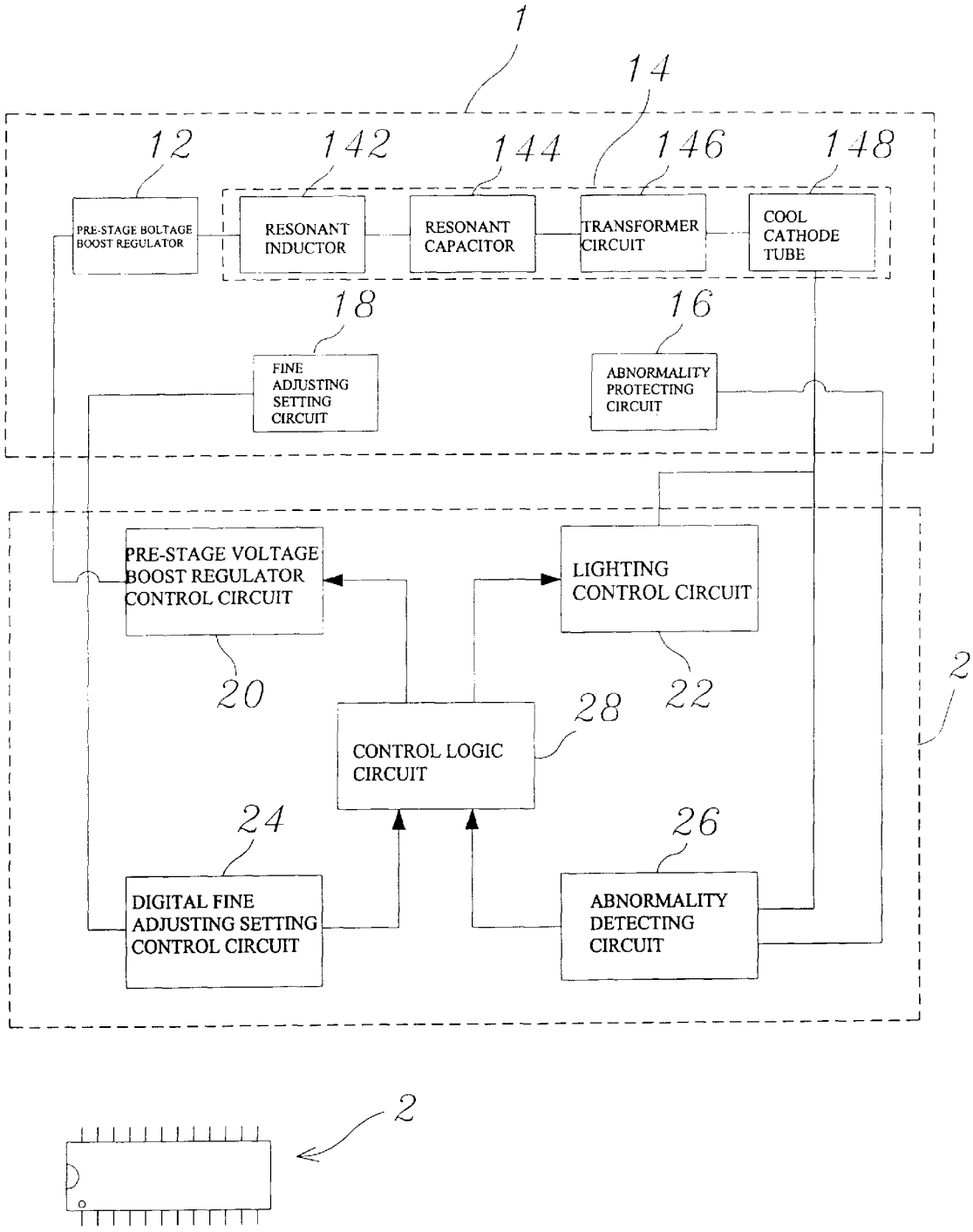
FIG. 1 shows the block diagram of the lighting device of the preferred embodiment of the present invention.

Referring to FIG. 1, the block diagram shows that the first preferred embodiment of the present invention is connected to a lighting device. As shown in the figures, the control device 2 mainly includes a regulator control circuit 20, a lighting control circuit 22, a digital fine-adjusting control circuit 24, an abnormality detecting circuit 26, and a control logic circuit 28. The control logic circuit 28 is connected with the regulator control circuit 20, lighting control circuit 22, digital fine-adjusting control circuit 24, and abnormality detecting circuit 26. The connection of the present invention will be described. The regulator control circuit 20 is serially connected to a pre-stage voltage boost regulator 12 and then is serially connected to a resonance inductor 142 of a lighting circuit 14. The abnormality detecting circuit 26 is connected to an abnormality protection circuit 16 and then is connected to a transformer circuit 146 of the lighting circuit 14. The fine-adjusting control circuit 24 is serially connected to a fine-adjusting setting circuit The control logic circuit 28 receives the feedback signals of the abnormality protection circuit 16 and the lighting circuit 14 through the abnormality detecting circuit 26. The control logic circuit 28 may receive the instructions of the fine-adjusting setting circuit 18 through the fine-adjusting control circuit 24. The control logic circuit 28 can exactly drive the working frequencies of the regulator control circuit 20 and the lighting control circuit 22 and makes these frequencies stable.

Figure 2A:
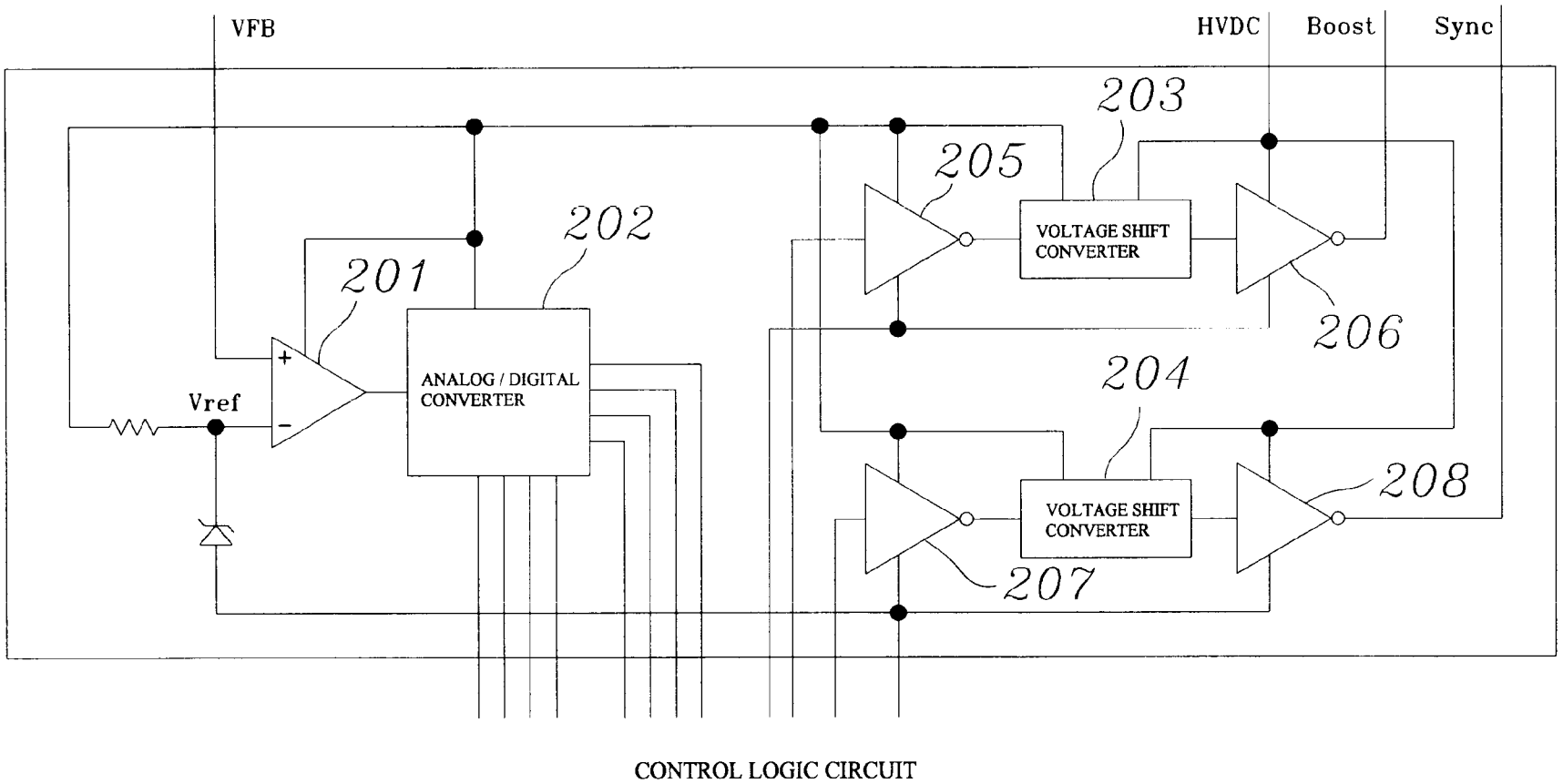
FIG. 2A is a circuit diagram of the resonance inductor of FIG. 1.
Figure 2B:
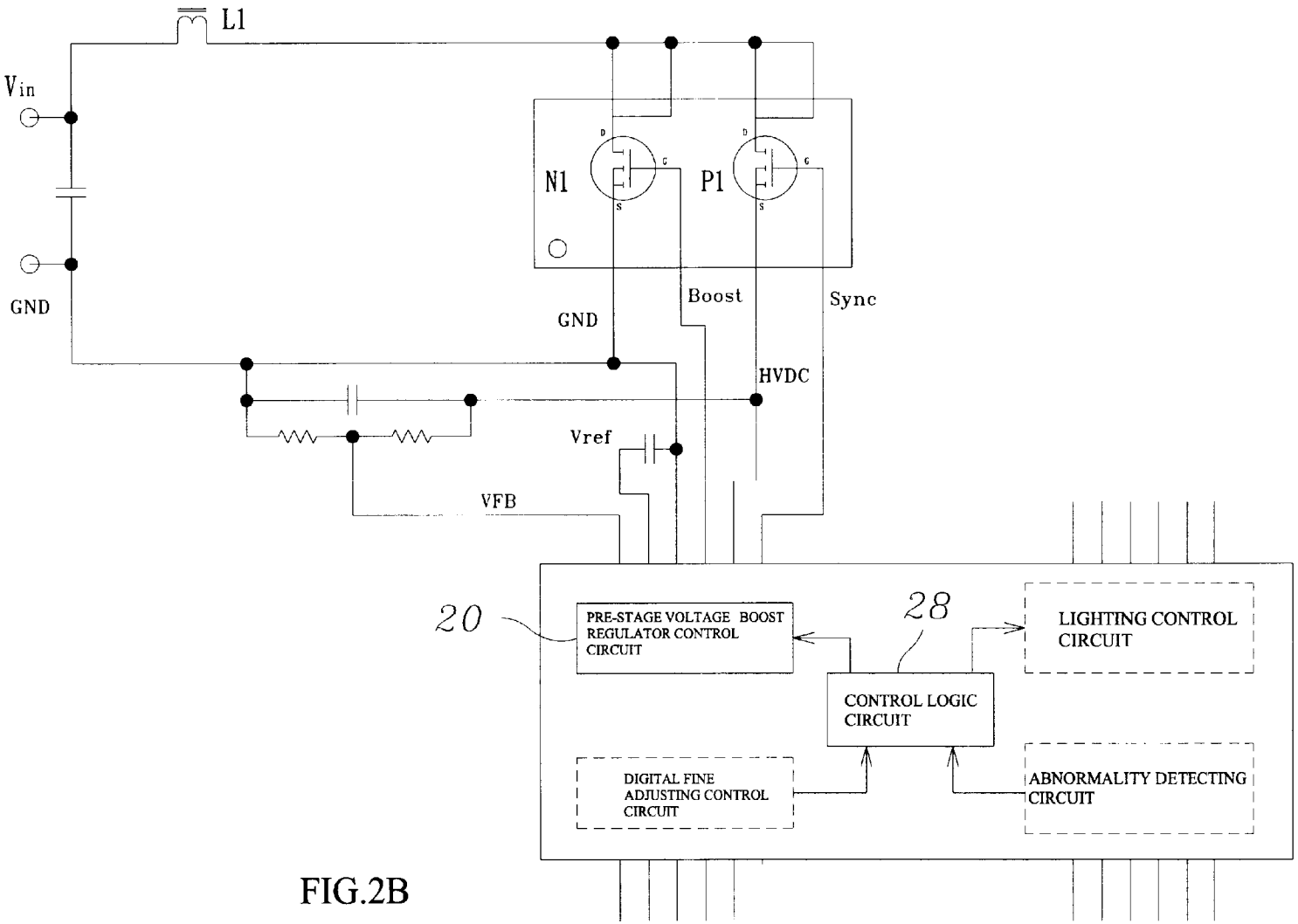
FIG. 2B is a circuit block diagram of the connection of the resonance inductor and the pre-stage voltage boost regulator.

Furthermore, referring to FIGS. 2A and 2B, the circuit block diagrams of the regulator control circuit and the pre-stage voltage boost regulator of FIG. 1 is illustrated. As shown in the figures, the main structure of the regulator control circuit 20 includes an operation amplifier 201. The positive input end of the operation amplifier 201 is connected to a feedback voltage VFB and the negative input end thereof is connected to a reference voltage Vref. The output end thereof is connected to an analog digital converter 202. A first voltage shift converter 203 has an input end connected to a NOT gate 205, and the output end connected is connected to a NOT gate 206 so as to output a Boost signal. A second voltage shift converter 204 has an input end connected to a NOT gate 207, and the output end thereof is connected to a NOT gate 208 and outputs a Sync signal. All the first voltage shift converter 203, second voltage shift converter 204, NOT gate 205, NOT gate 206, NOT gate 207 and NOT gate 208 are connected to a high voltage DC source HVDC. The mainly structure of the pre-stage voltage boost regulator 12 includes a voltage source Vin, which is serially connected to a boost inductor L1 and then is connected to the drain of an N channel power transistor N1 and the drain of the P channel power transistor P1 which are connected in parallel. The gate of the N channel power transistor N1 is connected to a Boost signal and the source thereof, is grounded. The gate of the P channel power transistor P1 is connected to a Sync signal and the source thereof is connected to the high voltage DC source HVDC. The feedback voltage VFB is compared with the reference voltage Vref provided by the regulator control circuit 20 through the operation amplifier 201, and then is transferred to the analog digital converter 202 for generating a digital signal. Then the optimum working time of the Boost and Sync signals are calculated based on the input voltage and the output power.

Since control logic circuit 28 calculates the optimum working time of the Boost signal outputted from the regulator control circuit 20, the N channel power transistor N1 is conducted. Then, current flows into the boost inductor L1 from the input voltage source Vin, and then to ground through the N channel power transistor N1. Thereby, the boost inductor L1 completes an energy storage period. Next, the Boost signal causes the N channel power transistor N1 to turn off. Then, the control logic circuit 28 calculates an optimum working time of the Sync signal outputted from the regulator control circuit 20, which may conduct the P channel power transistor P1. Then, current flows into the boost inductor L1 from the input voltage source Vin, and then to ground through the P channel power transistor P1. Thereby, the boost inductor L1 completes an energy releasing period. Next, the Sync signal causes the P channel power transistor P1 to turn off so as to complete an energy period. The regulator control circuit 20 causes the N channel power transistor N1 and P channel power transistor P1 in the pre-stage voltage boost regulator 12 to conduct and turn off repeatedly so as to complete all the cyclic period. Thereby, a steady high voltage DC source HVDC is provided as a power source of the lighting device 1. Furthermore, the lighting device 1 can work in a high voltage and a lower current to reduce effect of the temperature to the variation of current and effect of the input power source to the variation of current.

Figure 3A:
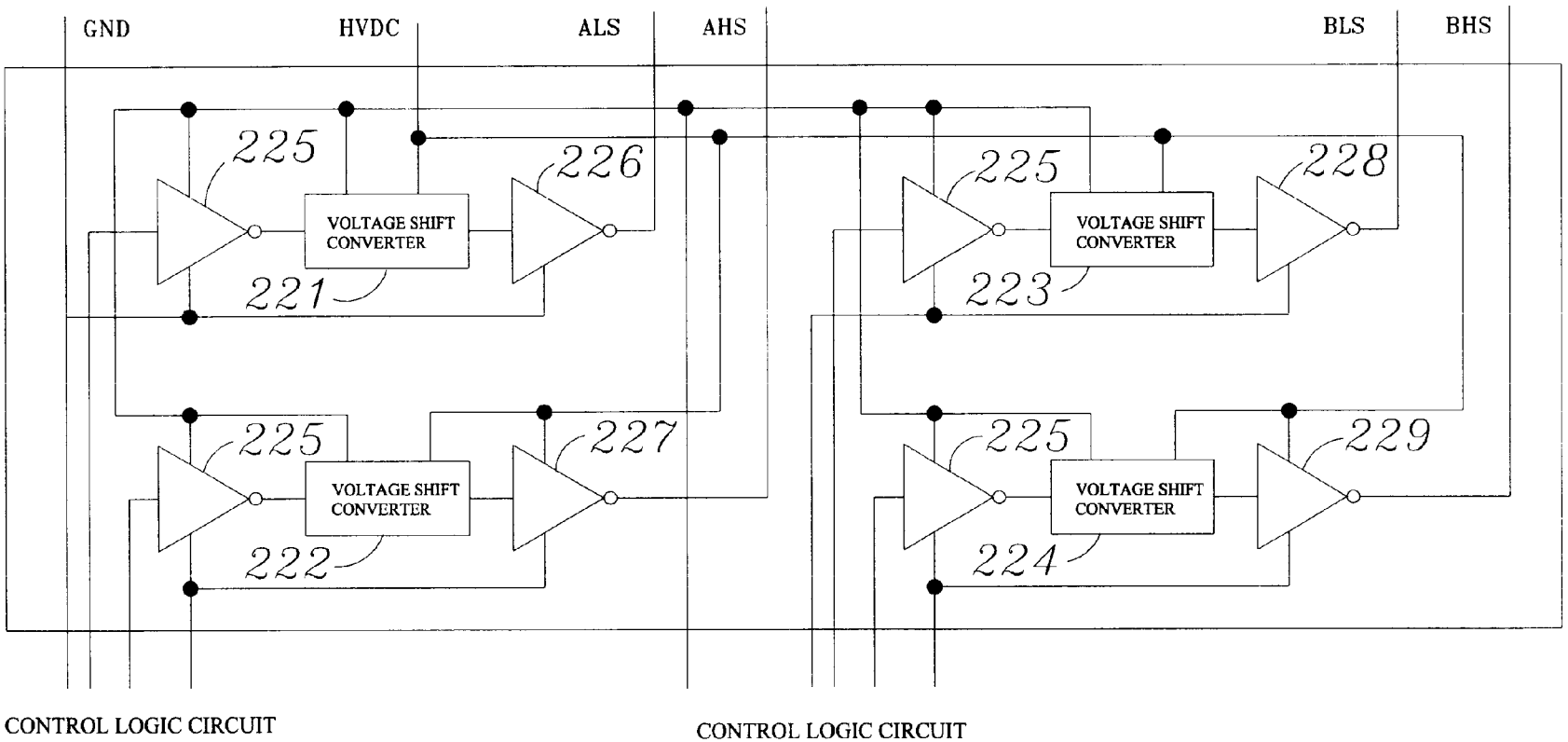
FIG. 3A is a control circuit diagram of the lighting device of FIG. 1.
Figure 3B:
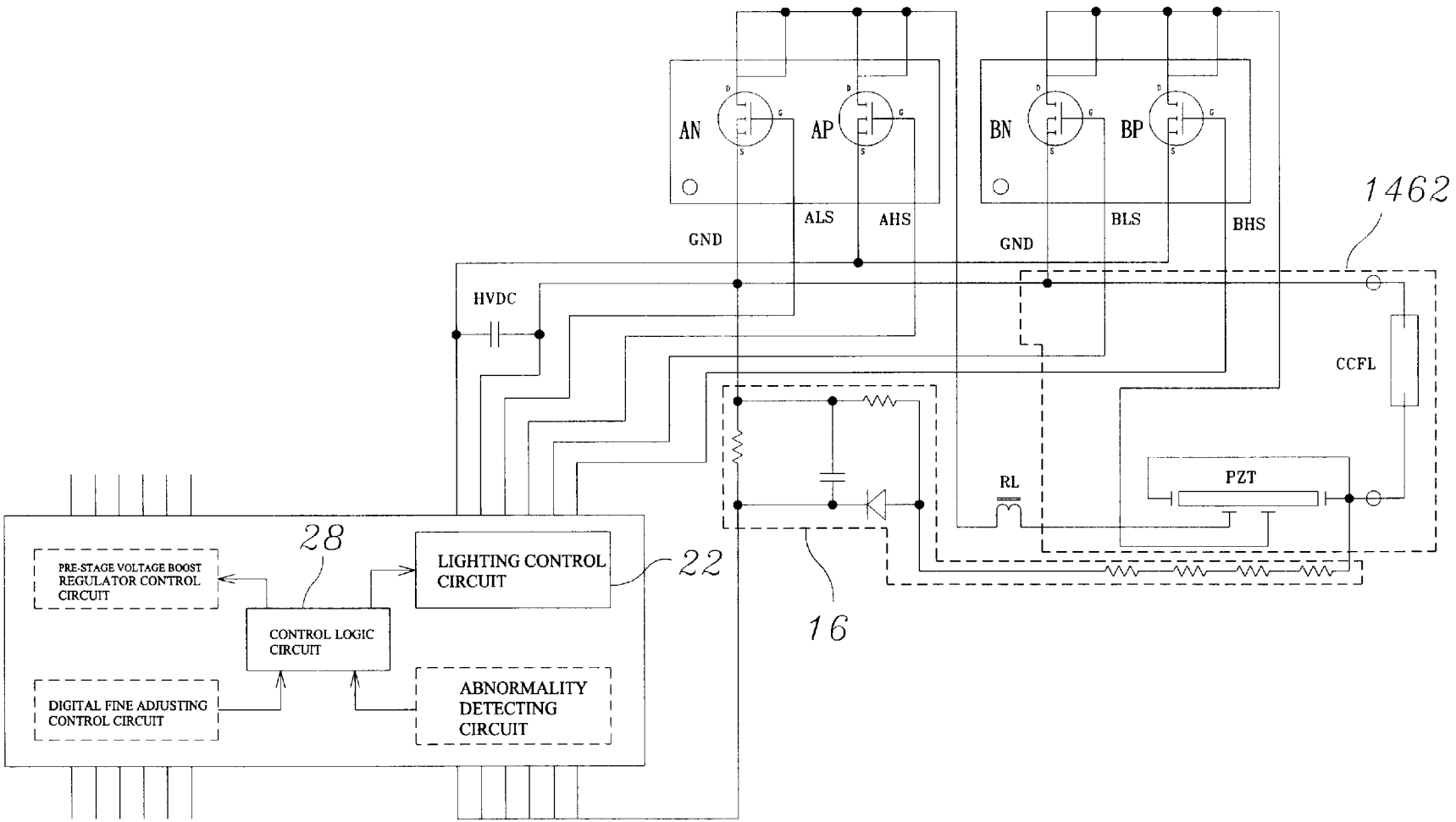
FIG. 3B is a circuit block diagram of the connection of the lighting control circuit and a piezoelectric transformer in the present invention.
Figure 3C:
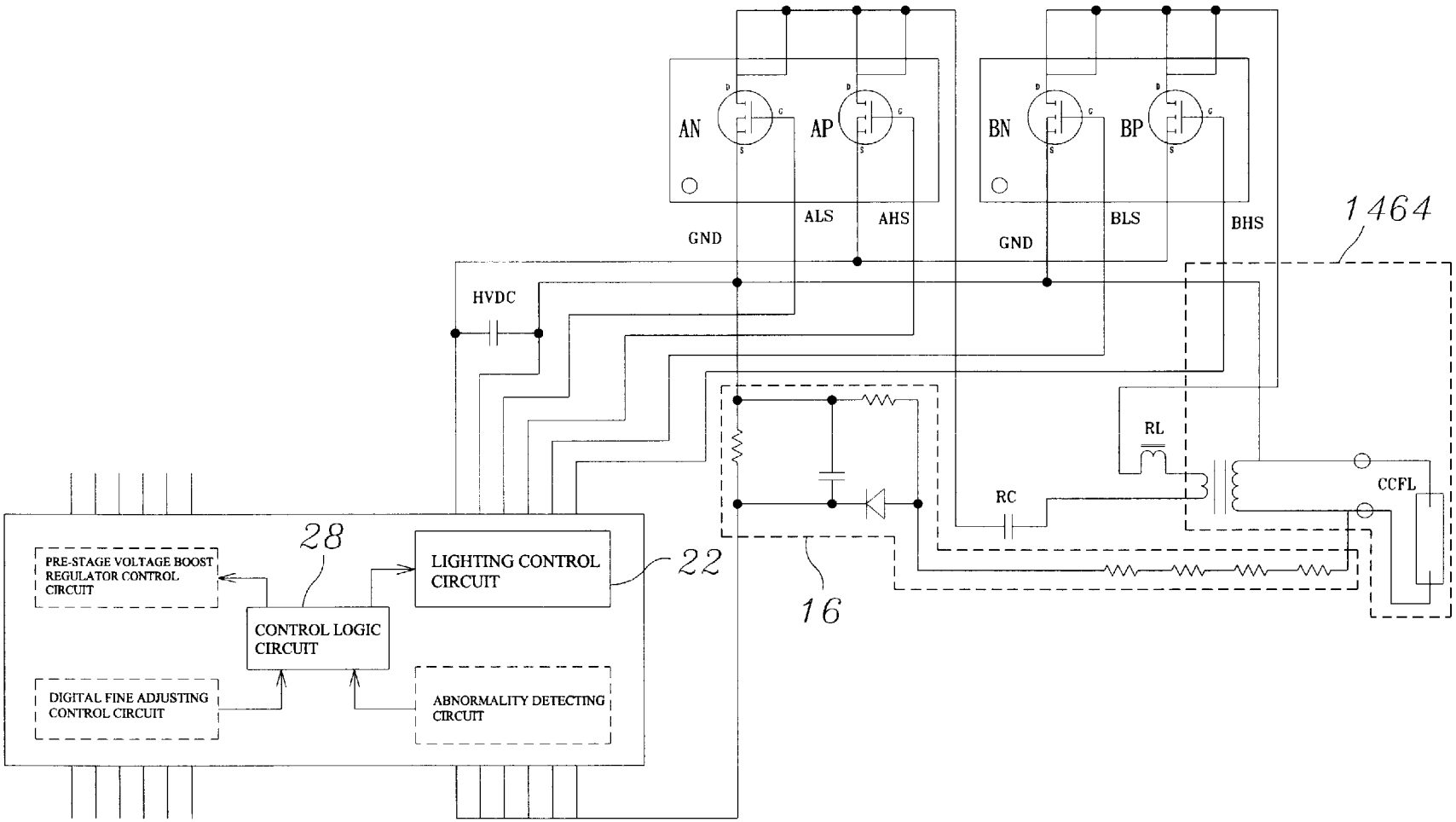
FIG. 3C is a circuit block diagram of the connection of the lighting control circuit and a coil transformer in the present invention.

Referring to FIGS. 3A, 3B and 3C, the circuit block diagrams of the lighting control circuit, the connection of the lighting control circuit and the piezoelectric transformer circuit, and the connections of the lighting control circuit and the coil transformer circuit. As shown in the figures, the lighting control circuit 22 includes a first voltage shift converter 221 having an output end serially connected to a NOT gate 226 and capable of outputting a signal ALS to the lighting circuit 14, a second voltage shift converter 222 having an output end serially connected to a NOT gate 227 and capable of outputting a signal AHS to the lighting circuit 14; a third voltage shift converter 223 having an output end serially connected to a NOT gate 228 and capable of outputting a signal BHS to the lighting circuit 14; and a fourth voltage shift converter 224 having an output end serially connected to a NOT gate 229 and capable of outputting a signal BHS to the lighting circuit 14. The input end of each of the voltage shift converters 221, 222, 223, and 224 is connected to a NOT gate 225 for receiving the timings T1, T2, T3, and T4 generated by the control logic circuit 28. The transformer circuit 146 may be selected as the ceramic (piezoelectric) transformer 1462 illustrated in FIG. 3B or the ceramic (piezoelectric) transformer 1462 illustrated in FIG. 3C. The ceramic (piezoelectric) transformer 1462 or the coil transformer 1464 is connected to a plurality of N channel power transistor AN and BN, a plurality of P channel power transistor AP and BP and the abnormality protection circuit 16.

The timings T1, T2, T3, and T4 are generated by the control logic circuit 28 and the optimum working times of the T1, T2, T3, and T4 are calculated and then are transferred to the lighting control circuit 22 to generate signals AHS, ALS, BHS, and BLS to control the operation of the transformer circuit 146.

For example, in the coil transformer 1464, the signal ALS drives the N channel power transistor AN to conduct, and BHS drives the P channel power transistor BP to conduct. The current flows out from the high voltage DC source HVDC and then through the resonant inductor RL to coil transformer 1464, and then returns to the negative end of the high voltage DC source HVDC so as to complete one fourth period of the transformer circuit 146. The signal ALS drives the N channel power transistor AN to turn off and the signal BHS drives the P channel power transistor BP to turn off so as to complete one fourth period of the transformer circuit 146. The signal BLS drives the N channel power transistor BN to conduct, and AHS drives the P channel power transistor AP to conduct, the current flows out from the positive end of the high voltage DC source HVDC to the coil transformer 1464 through the resonant capacitance RC, and then return to the negative end of the high voltage DC source HVDC through the resonant inductance RL so as to complete one fourth period of the transformer circuit 146. The signal BLS drives the N channel power transistor BN to turn off and.the signal AHS drives the P channel power transistor AP to turn off so as to complete one fourth period of the transformer circuit 146. The operation of the ceramic (piezoelectric) transformer 1462 is approximately identical to that of the coil transformer 1464.

The control logic circuit 28 conducts and turns off the power transistors AN, AP, BN, and BP repeatedly to complete each period to synchronize the output frequency of each regulator control circuit 20 and the output frequency of the lighting control circuit 22 so as to reduce the frequency difference harmonic interference and the electromagnetic interference. Furthermore, as temperature is changed, the lamp tube will compensates the natural resonant frequencies of the ceramic (piezoelectric) transformer 1462 and the coil transformer 1464 so that the effect of the temperature variation to the current variation of the lamp tube is reduced to a minimum. Moreover, a plurality of lamp tubes can be driven synchronously and the illuminations of the lamp tubes can be adjusted to assure every lamp tube has the same illumination.

Figure 4A:
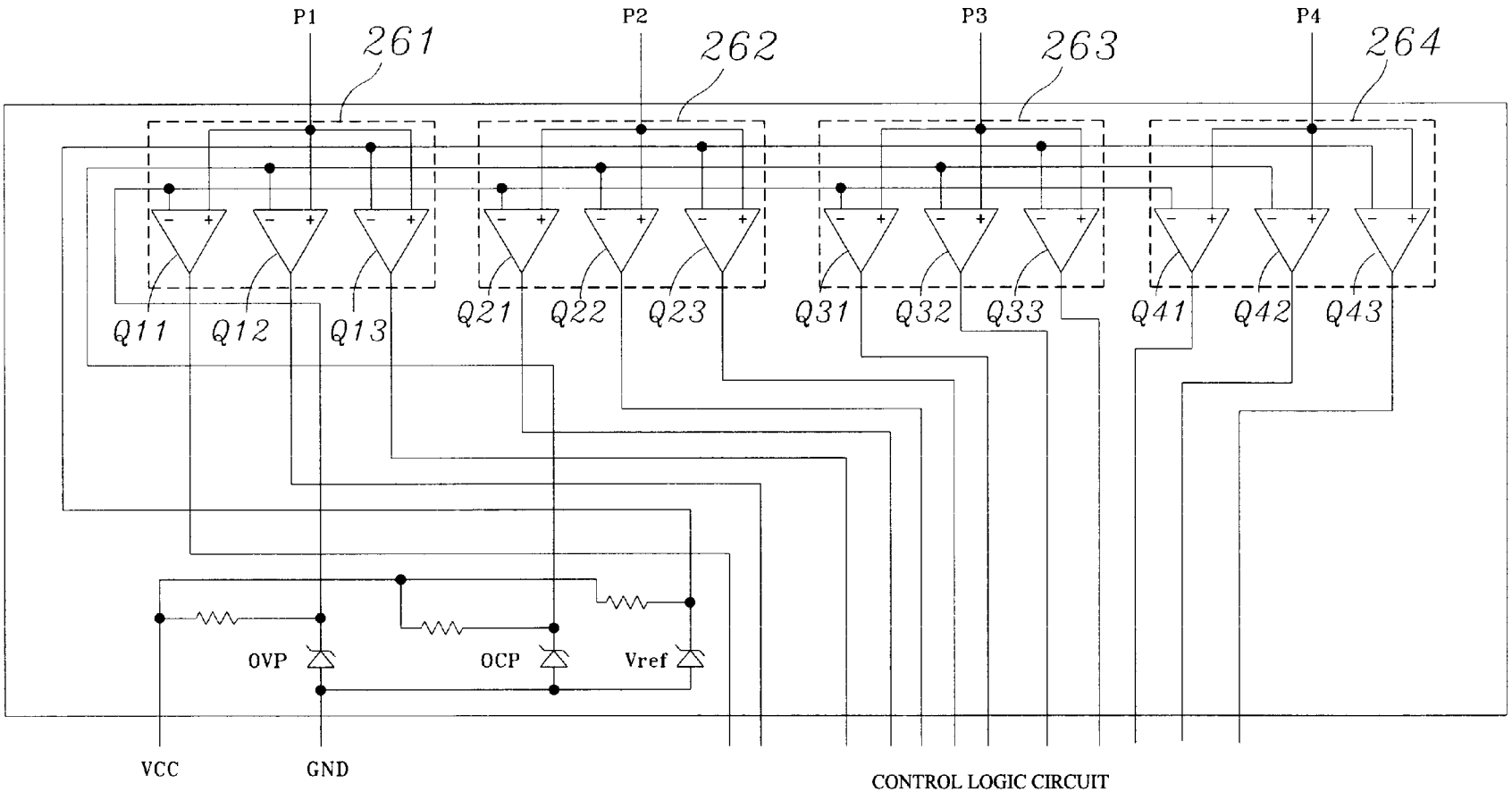
FIG. 4A is a circuit diagram of the abnormality detecting circuit in FIG. 1.
Figure 4B:
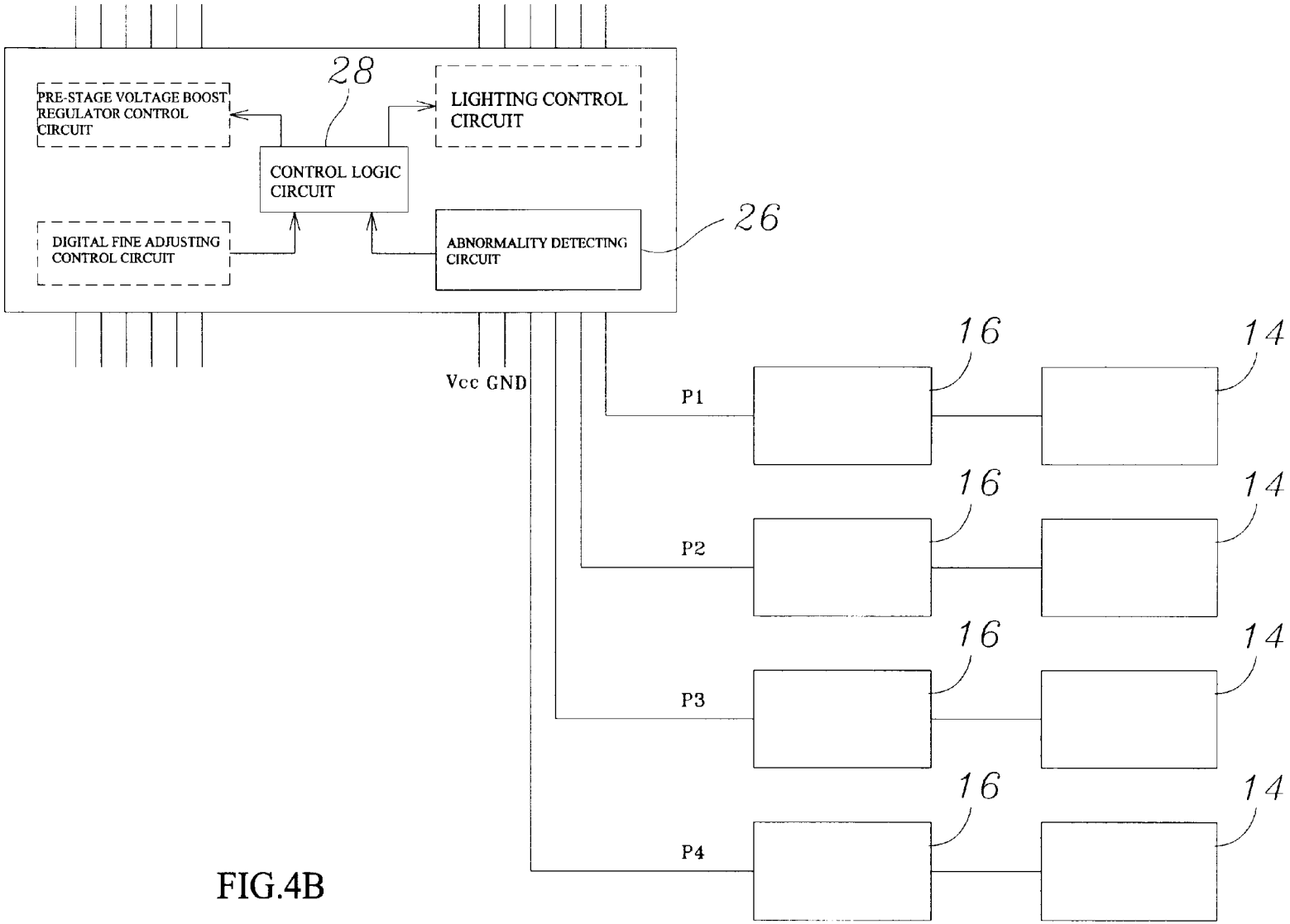
FIG. 4B is a circuit block diagram showing the connection of the abnormality detecting circuit, abnormality protection circuit, and transformer circuit.

Referring to FIGS. 4A and 4B, the circuit diagram of the abnormality detecting circuit and the circuit block diagram of the connection of each abnormality protection circuit are illustrated. As shown in the figures, each abnormality detecting circuit 26 includes a first comparing circuit 261, a second comparing circuit 262, a third comparing circuit 263, and a fourth comparing circuit 264. The first comparing circuit 261 includes a plurality of operation amplifiers which are Q11, Q12, and Q13. The positive input end of each operation amplifier is connected to a lighting circuit 14 through the abnormality protection circuit 16 for acquiring a detecting signal P1. The negative input ends of operation amplifiers are connected to an over voltage protecting reference voltage OVP, a over current protecting reference voltage OCP and a reference voltage Vref, respectively, and the output ends thereof are connected to the control logic circuit 28. The second comparing circuit 262 includes a plurality of operation amplifiers Q21, Q22, and Q23. The positive input end of each operation amplifier is connected to the lighting circuit 14 through the abnormality protection circuit 16 for acquiring a detecting signal P2. The negative input ends of operation amplifiers are connected to an over-voltage protecting reference voltage OVP, an over current protecting reference voltage OCP and a reference voltage Vref, respectively, and the output ends thereof are connected to the control logic circuit 28. The third comparing circuit 263 includes a plurality of operation amplifiers Q31, Q32, and Q33. The positive input end of each operation amplifier is connected to the lighting circuit 14 through the abnormality protection is circuit 16 for acquiring a detecting signal P3. The negative input ends of operation amplifiers are connected to an over-voltage protecting reference voltage OVP, an over-current protecting reference voltage OCP and a reference voltage Vref, respectively, and the output ends thereof are connected to the control logic circuit 28. The fourth comparing circuit 264 includes a plurality of operation amplifiers Q41, Q42, and Q43. The positive input end of each operation amplifier is connected to the lighting circuit 14 through the abnormality protection circuit 16 for acquiring a.detecting signal P4. The negative input ends of operation amplifiers are connected to an over voltage protecting reference voltage OVP, a over current protecting reference voltage OCP and a reference voltage Vref, respectively, and the output ends thereof are connected to the control logic circuit 28. The abnormality detecting circuit 26 knows the abnormality of the lighting device 1 through the abnormality protection circuit 16 to generate detecting signals P1, P2, abnormality protection circuit 16 to generate detecting signals P1,P2, P3 and P4. Then the detecting signals P1, P2, P3 and P4 are compared by the comparing circuits 261, 262, 263, and 264 so as to detect the over voltage due to open circuit of the load, over current due to short circuit of the load, and tracking effects of the variation of the temperature to the variations of natural resonance frequency and the lighting frequency.

Figure 5A:
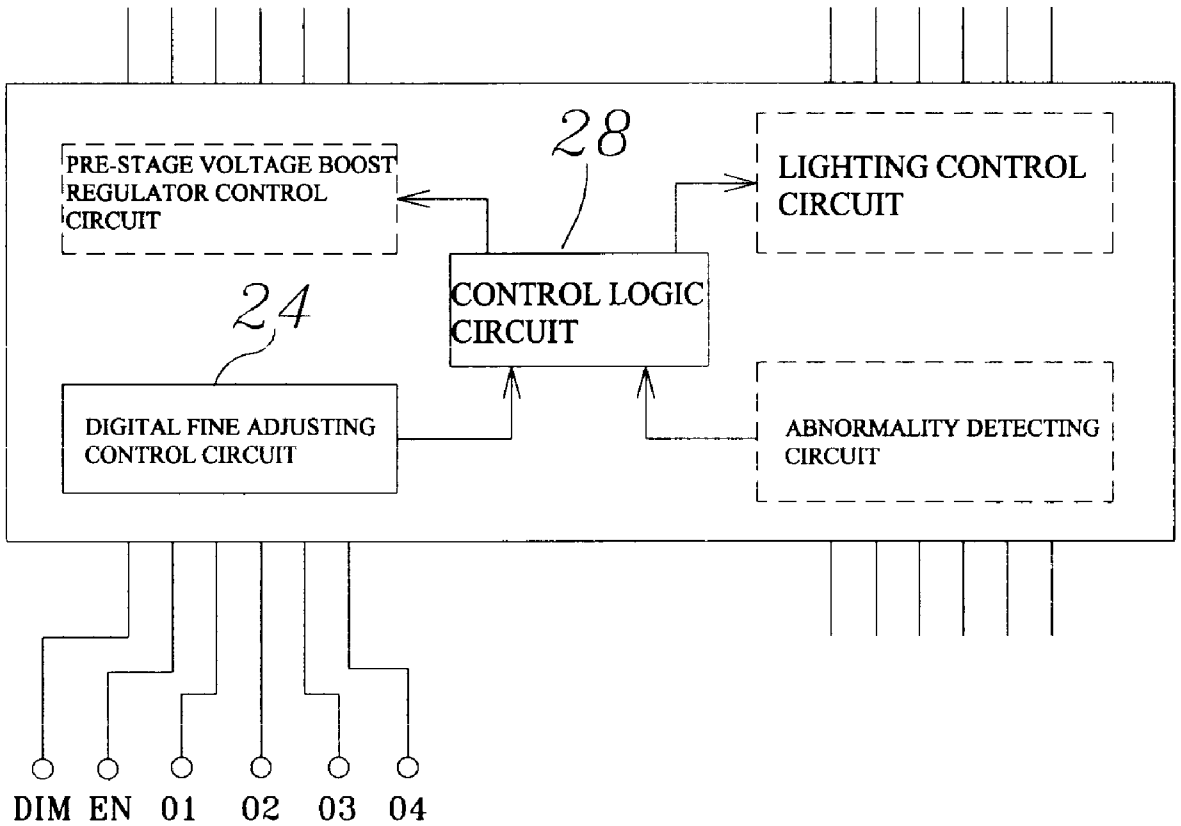
FIG. 5A is a circuit block diagram of the fine-adjusting control circuit of FIG. 1.
Figure 5B:
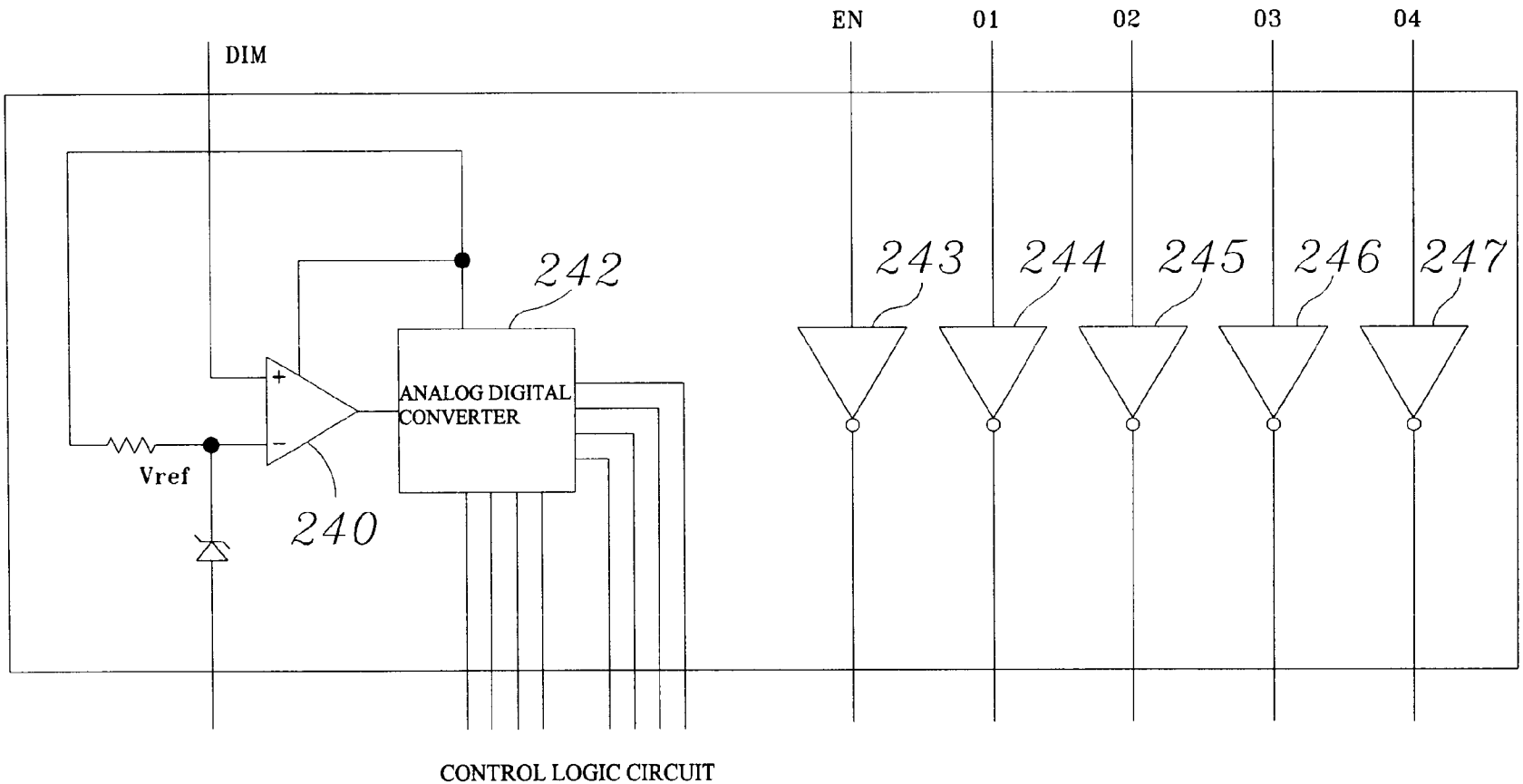
FIG. 5B is a circuit block diagram of the fine-adjusting control circuit and the fine-adjusting setting circuit.

With reference to FIGS. 5A and 5B, the circuit block diagrams of the fine-adjusting control circuit and the fine-adjusting setting circuit of FIG. 1 are illustrated. As shown in the figures, the structure of the fine-adjusting control circuit 24 mainly includes an operation amplifier 240. The negative input end of the operation amplifier 240 is connected to a reference voltage Vref and the output end thereof is connected to an analog digital converter 242. The positive input end thereof is connected to a fine-adjusting setting instruction DIM. The result from the comparison of the reference voltage Vref and the fine-adjusting setting instruction DIM by the operation amplifier 240 is converted into a digital signal by the operation amplifier 240 and then is transferred to the control logic circuit 28 for operation. In another aspect, the fine-adjusting control circuit 24 includes a plurality of NOT gates 243, 244, 245, 246, and 247 and receives the fine-adjusting setting instructions EN, 01, 02, 03, and 04, and then sends out the fine-adjusting setting instructions DIM, EN, 01, 02, 03, and 04 to control logic 28 for operation. Then the control logic circuit 28 uses the result to control the pre-stage voltage boost regulator 12 and the lighting circuit 14 through the regulator control circuit 20 and the lighting control circuit 22 so as to drive the plurality of lamp tubes synchronously and adjust the illuminations of the lamp tubes so that they have the same illuminations. Therefore, by the fine-adjusting control circuit 24 to receive the instructions from the fine-adjusting setting circuit 18, the color temperature, closing time of the abnormality protection circuit and the reference voltage Vref can be adjusted.

Besides, in the present invention, the regulator control circuit may be a control circuit of a pre-stage voltage boost regulator. The fine-adjusting control circuit thereof can be a digital fine-adjusting control circuit. Besides, the control device of the present invention may be a chip set for matching the requirement of compactness and may be a distributed circuit.

In summary, the present invention relates to a control device, especially a cool cathode tube control circuit. In that, a control logic circuit is electrically connected with a regulator control circuit, a lighting control circuit, a fine-adjusting control circuit, and an abnormality detecting circuit for receiving the signals from the lighting device, fine-adjusting control circuit, and abnormality protection circuit. The signals are processed to output digital signals for driving pre-stage voltage boost regulator and the lighting circuit of the lighting device. Therefore, a plurality of lamp tubes are luminous synchronously to have the same illumination. As a result, effect of the temperature to the variation of current and effect of the input power source to the variation of current can be compensated.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A cool cathode tube control circuit comprising:

a regulator control circuit for controlling a lighting device to provide a steady high voltage power source;

a lighting control circuit for controlling the lighting device so as to drive a plurality of lamp tubes synchronously and adjusting the illuminations of the lamp tubes;

an abnormality detecting circuit connected to the lighting device for sensing abnormal signals; and a control logic circuit electrically connected to the regulator control circuit, the lighting control circuit and the abnormality detecting circuit for receiving and processing input signals from the abnormality detecting circuit so as to generate logic digital signals to be transferred to the regulator control circuit and the lighting control circuit; thereby, the lighting device being driven so that the plurality of lamp tubes are actuated synchronously and have the same illumination.

2. The control device as claimed in claim 1, wherein the regulator control circuit is a control circuit of a pre-stage boost regulator.

3. The control device as claimed in claim 1, wherein main components of the regulator control circuit comprising:

an operational amplifier having a positive input end for receiving a feedback voltage from the lighting device and a negative input end connected to a reference voltage;

an analog digital converter electrically to an output of the operational amplifier and the control logic circuit;

a first voltage shift converter having an input end serially connected to a first NOT gate for receiving signals from the control logic circuit and an output end serially connected to a second NOT gate for outputting a boost signal to the lighting device; and a second voltage shift converter having an input end serially connected to a third NOT gate for receiving signals from the control logic circuit and an output end serially connected to a fourth NOT gate for outputting a synchronous signal to the lighting device.

4. The control device as claimed in claim 1, wherein the main structure of the lighting device includes a plurality of voltage shift converters each having an input end serially connected to a NOT gate for receiving signals from the control logic circuit, and an output end serially connected to a NOT gate for outputting signal to the lighting device for controlling the action of the lighting device.

5. The control device as claimed in claim 1, wherein the lighting device is one of a coil transformer and a piezoeletric transformer.

6. The control device as claimed in claim 1, wherein the control device is a selected one of a chipset and a discrete circuit.

7. The control device as claimed in claim 1, wherein the abnormality detecting circuit includes a plurality of comparators each receiving feedback signals from a load and then transferring a condition of the load to the control logic circuit.

8. The control device as claimed in claim 7, wherein each comparator is formed by a plurality of operational amplifiers, a negative input end of each operational amplifier is connected to a reference voltage and a positive end thereof is connected to a lighting device, and an output end thereof is connected to a control logic circuit.

9. The control device as claimed in claim 1, further comprising a fine-adjusting control circuit which is connected to a fine-adjusting setting circuit for receiving various settings and converting into digital signals and then transferring to a control logic circuit.

10. The control device as claimed in claim 9, wherein the fine-adjusting control circuit is a digital fine-adjusting control circuit.

11. The control device as claimed in claim 9, wherein the fine-adjusting control circuit mainly comprises:

an operational amplifier having a positive input end for receiving a fine-adjusting setting signal from the lighting device and a negative input end connected to a reference voltage;

an analog digital converter electrically connected to an output of the operational amplifier and the control logic circuit; and a plurality of NOT gate for receiving fine-adjusting setting signals from the lighting device and then transferring these signals to the control logic circuit.

12. The control device as claimed in claim 9, wherein the fine-adjusting control circuit is a selected one of a chipset and a discrete circuit.

* * * * *